US007905281B2

(12) United States Patent
Fitzgerald

(10) Patent No.: US 7,905,281 B2
(45) Date of Patent: Mar. 15, 2011

(54) METHOD FOR DETERMINING THE SIZE OF TUBULAR PIPE TO BE INSERTED IN A BOREHOLE

(75) Inventor: Peter Fitzgerald, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 150 days.

(21) Appl. No.: 11/952,607

(22) Filed: Dec. 7, 2007

(65) Prior Publication Data

US 2008/0149331 A1 Jun. 26, 2008

(30) Foreign Application Priority Data

Dec. 21, 2006 (EP) ..... 06126866

(51) Int. Cl.
*E21B 47/00* (2006.01)

(52) U.S. Cl. ..... 166/250.01

(58) Field of Classification Search ..... 166/250.01
See application file for complete search history.

(56) References Cited

U.S. PATENT DOCUMENTS 2,595,241 A * 5/1952 Goble ..... 367/102
3,364,464 A 1/1968 Dellinger
3,961,683 A * 6/1976 Delignieres ..... 181/102
6,044,326 A * 3/2000 Huiszoon ..... 702/8
6,078,867 A 6/2000 Plumb et al.

OTHER PUBLICATIONS

Wagg, B.T. and Matthews, C.M. 2000. Evaluating Casing Deformation. World Oil, Dec. 2000, p. 44-46.

C. Labat, S. Brady, M. Everett, D. Ellis, M. Doghmi, J.C. Tomlinson, G. Shehab: "3D Azimuthal LWD Caliper," Society of Petroleum Engineers, vol. SPE, No. 77526, Sep. 29-Oct. 2, 2002, p. 1-17, XP002434221 San Antonio.

* cited by examiner

*Primary Examiner* — Jennifer H Gay
*Assistant Examiner* — Catherine Loikith
(74) *Attorney, Agent, or Firm* — Dave R. Hofman

(57) ABSTRACT

A method for determining the size of tubular pipe to be inserted into an interval of cased or uncased borehole is disclosed. The position of the borehole wall or innermost casing surface in the interval is determined and a window length that is less than the length of the interval is defined. A series of windows along the interval is defined and for each window, the determined position of the borehole wall in that window is used to define a polygon, the edges of which are defined by the parts of the borehole wall closest to the borehole axis in that window. The maximum size of pipe diameter that will fit inside the polygon in each window without intersecting the edges is determined and the size of pipe to be inserted into the interval selected based on the maximum size of diameter pipe determined for each window.

18 Claims, 4 Drawing Sheets

METHOD FOR DETERMINING THE SIZE OF TUBULAR PIPE TO BE INSERTED IN A BOREHOLE

TECHNICAL FIELD

This invention relates to a method for determining the size of casing or other tubular pipe to be inserted in a borehole. Such methods find application, for example, in the casing and completion of boreholes such as oil and gas wells.

BACKGROUND ART

When constructing wells such as oil or gas well, it is common to drill a borehole and then line it using a steel casing. The steel casing is formed by joining a number of tubular casing sections end to end and running them into the borehole. Once the casing is in place, cement is pumped down the casing so as to exit at its lower end and return to the surface and fill the annulus between the outside of the casing and the borehole wall.

During the drilling process, boreholes sometimes take on a "corkscrew" or helical path. This most often occurs in deviated wells, and may be the result of inappropriate bottom hole assembly selection, excessive weight-on-bit, or the need for continuous trajectory corrections. As a result, when the driller tries to run casing into the borehole, problems may be encountered. The profile of the borehole may very close to a perfect circle of diameter greater than that of the casing to be run. If the casing to be run is very flexible, it will be able to follow the turns of the borehole, and all will be well. Realistically, however, casings are relatively stiff. As a result, they are often unable to comply with the borehole trajectory and may, in the limit, not be able to go downhole. In a "corkscrewed" borehole, the borehole may be locally circular, but the centre of this circle when traced along the borehole describes neither a straight line nor a smooth curve (as might be expected in a deviated well), but instead traces a helical path. This can result from the drilling process. In such a situation, a 16" diameter borehole may be so tortuous that a 13.375" diameter casing can become stuck due to contact with the borehole wall before it can be fully run into place. The cost of getting stuck in such situations can be very high, running into millions of dollars in extreme situations.

The problem is to determine the maximum diameter of casing that will pass through the borehole without being unduly affected by its tortuosity, irrespective of the local diameter of the borehole.

Previous proposals have been made to determine curvature and deformation of cased or lined boreholes. For example, the CALTRAN™ software product package of C-FER TECHNOLOGIES™ that uses raw caliper-log data from a multi-sensor caliper tool to determine the 3D shape of downhole tubulars. 3D drift diameter accounts for curvature and ovalisation and allows an estimate of what size tool will fit downhole.

This invention seeks to provide a method which is applicable to uncased or unlined (i.e. 'open') boreholes and to cased or lined wells.

DISCLOSURE OF THE INVENTION

This invention provides a method for determining the size of tubular pipe to be inserted into an interval of borehole, comprising:

determining the position of the borehole wall in the interval:

defining a window length that is less than the length of the interval and defining a series of windows along the interval;

for each window, using the determined position of the borehole wail in that window to define a polygon, the circumference of which is defined by the parts of the borehole wall closest to the borehole axis in that window;

determining the maximum size of pipe diameter that will fit inside the polygon in each window without intersecting the circumference, selecting the size of pipe to be inserted into the interval based on the maximum size of diameter pipe determined for each window.

Preferably, the method further comprises defining a point in each window to which the determined maximum pipe diameter is assigned, This will typically be the mid-point of the window. Each window is preferably separated from its neighbours by a predetermined distance, such as one data sample for a typical logging tool.

A particularly preferred way of determining the position of the borehole wall comprises making a series of calliper measurements at different depths in the borehole. In this case, the step of defining a polygon preferably comprises connecting calliper measurement points around the borehole in the window.

Typically, the step of determining the position of the borehole wall is performed using a measurement toot comprising a tool body that is moved through the borehole, the method comprising determining any rotation of the toot body as it is moved through the well and using the determined rotation to correct the determination of the position of the borehole wall. The method can also further comprise determining any lateral displacement of the tool body as it is moved through the borehole, and using the determined lateral displacement to correct the determination of the position of the borehole wall.

Selection of the window length can be made according to the bending stiffness of the pipe.

Selecting the size of the pipe to be less that the minimum maximum pipe diameter determined in any window in the interval is particularly desirable.

The invention has the advantage that it enables a casing size to be selected which minimises contact with the wall of the borehole and so helps reduce sticking problems when running into the boreholes. It can be applied in open or cased holes and used for determining the size of any tubular to be inserted into the borehole, for example casing, completion tubulars, etc.

MODE(S) FOR CARRYING OUT THE INVENTION

This invention provides a method for determining a maximum tool diameter that will fit in a borehole that has a tortuous path. For the purposes of this description the borehole is considered as one that has been drilled imperfectly so that, although the local profile of the borehole at each depth is approximately circular, the centre of this "local circle" traces a helical path in space as we move along the borehole 10 (see FIGS. 1 and 2).

Figure 1:
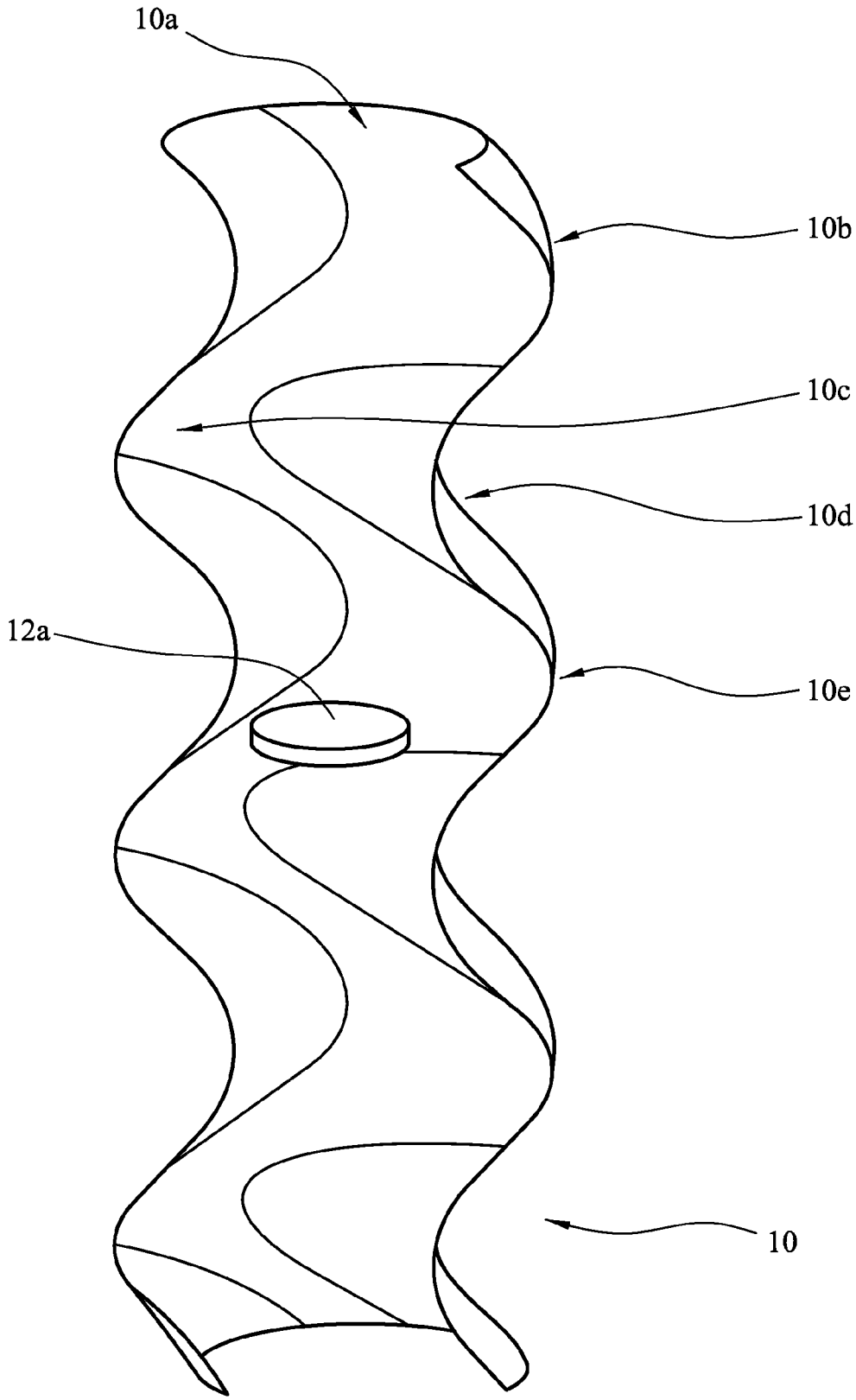
FIG. 1 shows a schematic section of a tortuous borehole with an infinitely short tool.

At one extreme, a measurement tool for measuring the local borehole profile can be considered as an infinitely short cylindrical logging tool 12*a* (see FIG. 1). For purposes of this explanation, the tool will be assumed to be a multi-finger calliper tool, although any of a number of other techniques may be used (for example a rotating ultrasonic sensor) for estimating displacement from the toot to the borehole wall in an azimuthally-sensitive fashion. In this example, when reference is made to "fingers", this can likewise be used to mean the general set of measurements made by such a tool. The tool 12*a* can be centralized in the local borehole and the fingers, or other measurement devices (not shown), can then measure its local shape or profile at various measurement stations along the length of the interval of the borehole of interest. Measurement tools such as multifinger callipers typically make measurements every 6 inches (15 cm) along the interval of interest.

As the tool 12*a* is moved along the borehole 10, the entire tool body will be displaced laterally as the path of the borehole changes. The lateral movement of the tool 12*a* can be inferred using an accelerometer (such as are typically provided in such logging tools), and doubly-integrating the acceleration. As this lateral movement describes the helix which is the locus of the centre of the borehole 10, the precise form of the borehole in three-dimensional space, referred to the rock and not the tool axis, may be computed by combining the movement of the tool's axis (as determined from the accelerometer measurements) with the tool's finger measurements (giving the local borehole profile at each measurement station.

Figure 2:
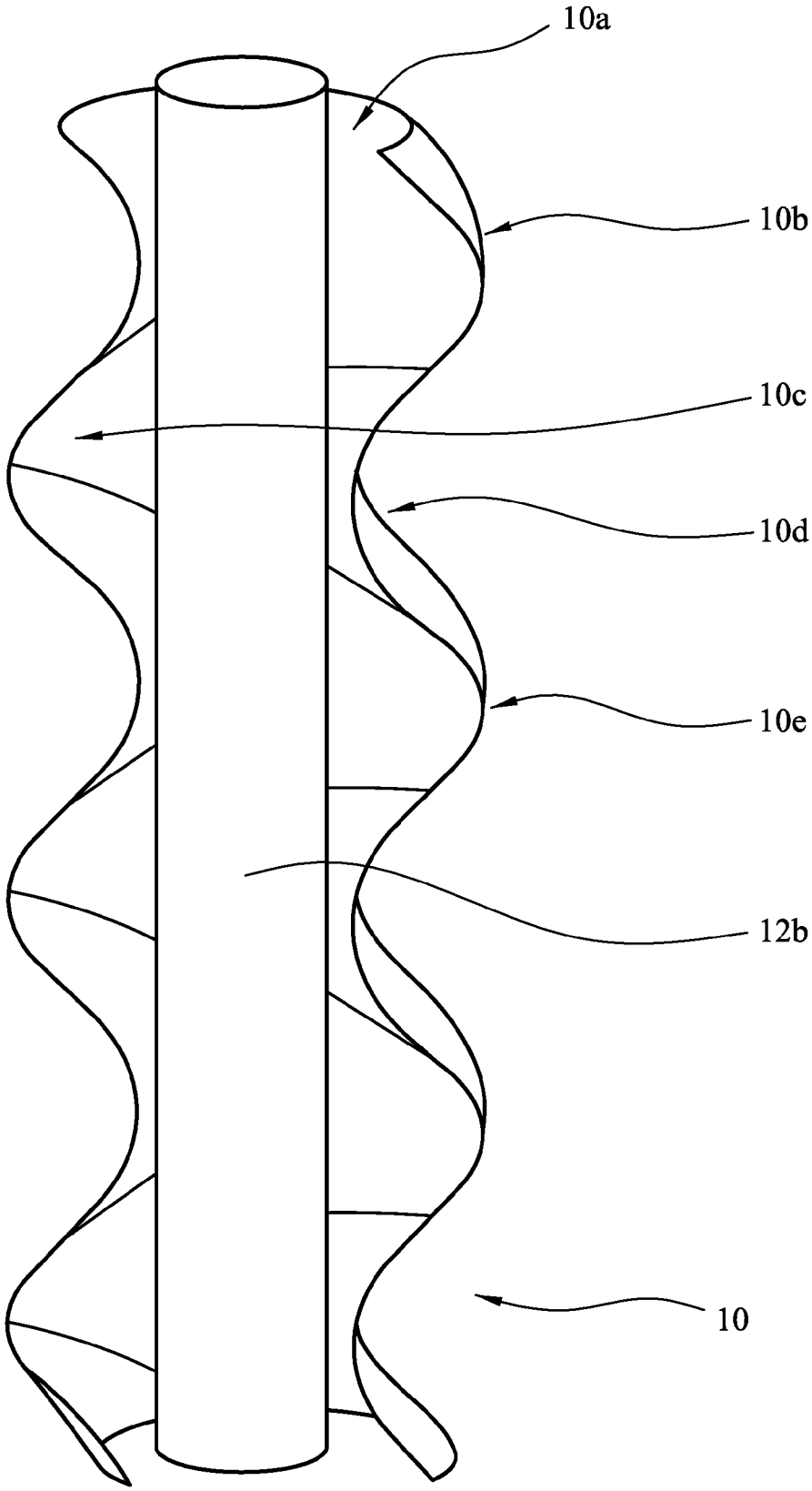
FIG. 2 shows a corresponding section with an infinitely long tool.
Figure 3:
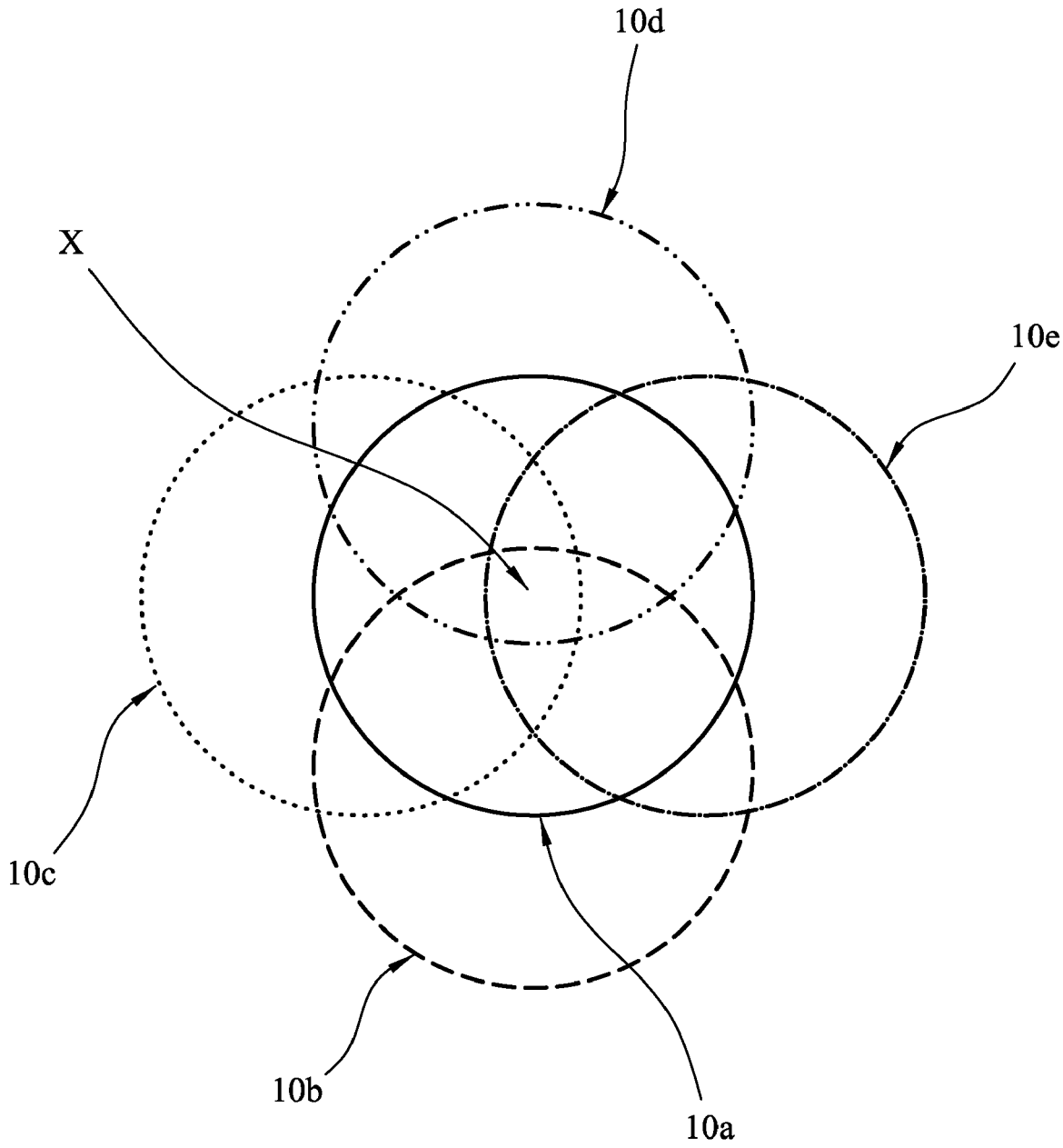
FIG. 3 shows a top View of the borehole of FIGS. 1 and 2 with profiles at different depths.

At the other extreme, the tool 12*b* can be considered as infinitely long and very stilt and unable to bend to follow the helical path of the borehole (see FIG. 2). In this case, the tool axis is not displaced laterally as the tool 12*b* moves along the borehole 10. However, the tool's multiple fingers will "see" the (roughly circular) local borehole shape rotating about the tool axis, as the local borehole centre is not coincident with the tool's axis, but rotates about it as a function of distance along the borehole. FIG. 3 shows a top view of the borehole 10*a* and its local profile at four stations 10*b*, 10*c*, 10*d*, 10*e* along the borehole. The helical nature of the borehole may be inferred from the rotating "excentralisation vector" of the finger measurements.

In a real case, the tool length will be neither infinitely long nor infinitely short. In addition, the tool may rotate about its own axis as it moves along the borehole (such motion is common in logging tools). The behaviour to be expected of the lateral acceleration and finger measurements may therefore be expected to fall somewhere between the two extreme theoretical cases described above. However, combination of data from the accelerometer and the tool's finger measurements allows the precise form of the borehole in three-dimensional space to be determined. Relatively simple geometrical calculations may be used to estimate the maximum diameter of rigid pipe that may be run through a given section of the borehole with minimal risk of sticking.

In its simplest form, the methods provided by the invention comprise two steps:

Determine true location of the borehole wall Vector; and

Compute the maximum pipe diameter.

Determination True Location of the Borehole Wall

In the case where lateral displacement of the tool is ignored (the "infinite tool" case of FIG. 2) then this is indicated directly by the tool's finger measurements. However, if the entire tool is rotating about its axis as it moves along the borehole, individual finger measurements of the tool may need to be "reassigned" to other azimuthal positions in the borehole. This rotation can be inferred from measurements made by a relative bearing or azimuth sensor in the tool 12*a*, 12*b* (or toolstring of which the tool 12*a*, 12*b* forms part).

Computation of the Maximum Pipe Diameter

Figure 4:
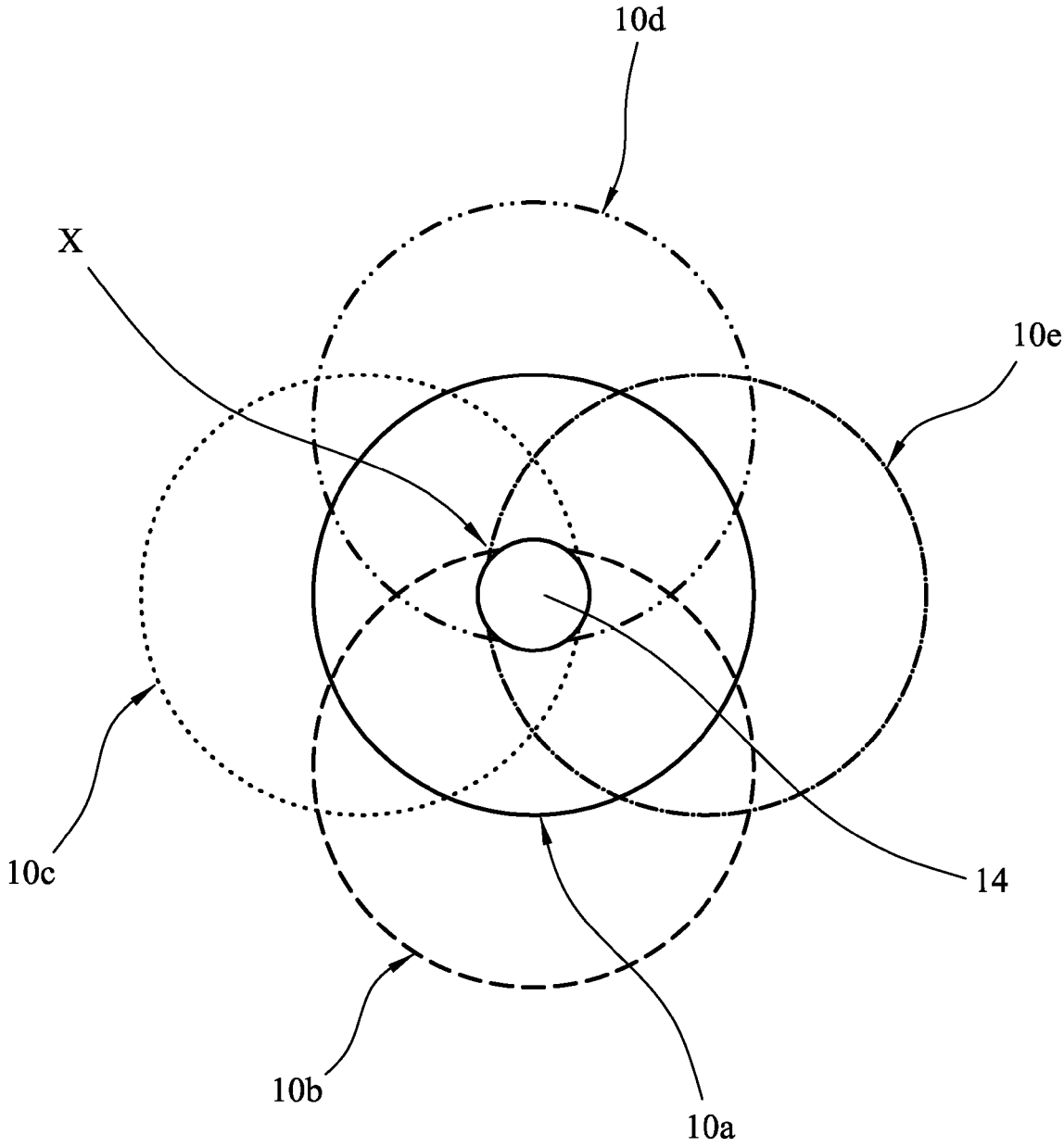
FIG. 4 shows a corresponding view to FIG. 3 with a maximum pipe diameter indicated.

As the tool moves along the borehole, one can think of the borehole profile at the depth of the fingers as being excentralised, and rotating about the toot axis. This is illustrated in FIG. 3, in which the dotted circles 10*b*, 10*c*, 10*d*-10*e* indicate the position of the borehole with respect to the tool axis over a certain range of depths (see FIGS. 1 and 2). As can be seen in FIG. 4, there is around the tool axis a zone 14 into which none of the apparent borehole positions 10*b*-10*e* projects. If, for example, FIG. 4 represents one hundred feet of borehole (approx. 30 m), and is considered in isolation from all other borehole sections, the circle 14 shown in FIG. 4 represents the maximum pipe diameter that could pass through this borehole section without touching the borehole wall at any point. Conversely, attempting to pass a pipe of larger diameter would lead to the pipe touching at more than one point around the borehole wall (perhaps at different depths), and thus risk becoming stuck.

Implementation of this method comprises taking the minimum displacement from the tool axis at each azimuth over a certain length of borehole interval (the "Filter window"), and from this constructing a two-dimensional polygon. In the case of FIG. 3, this polygon corresponds to the shape of the region X around the centre. The diameter of the largest circle that can fit within this polygon is then computed, for example, by adding opposite radii and determining the minimum radius that does not intersect any of these points. This is assumed to be the "maximum pipe diameter" that will be able to fit into this depth interval and can be assigned to a predetermined position in the filter window (typically the middle position).

The filter window is then advanced along the interval, for example by one measurement station (6 inches/15 cm) and the computation repeated. Repeating this for the whole of the interval of interest allows a log to be constructed of the computed maxima. The casing or tubular to be installed in this section of the well can then be selected to be below the lowest maximum computed for this interval.

The length of the filter window can be chosen to be representative of the bending stiffness of the pipe, casing or tubular, as some conformance to non-linear boreholes is to be expected. Indeed without such bending it would be impossible to run casing in any deviated borehole with a vertical section near surface. A filter length of 120 ft (36 m) has been found to give useful results for intervals of 1000 ft (300 m) in a 16 inch (41 cm) diameter borehole in certain circumstances but this is dependent on conditions and filter lengths between 30 ft (9 m) and 150 ft (45 m) may be appropriate in other cases.

A more detailed implementation of methods according to the invention comprise the further step of computing the lateral displacement of the tool body during its progress along the interval as it makes measurements. This step essentially involves doubly-integrating the transverse acceleration components versus time, assuming that certain boundary conditions (zero transverse velocity and displacement) are, met at time zero. In practice, however, filtering may be required to ensure that the transverse displacement of the tool is constrained to physically plausible values. Kalman filtering techniques may be used, in a manner analogous to those used for speed-correcting data for logging tool measurements.

The step of determining the true location of the borehole wail then comprises performing a vector addition of the tool-axis-displacements computed as indicated in the previous section, and the vector that each finger measurement represents.

The computation of the maximum pipe diameter is then performed in the manner described above.

The methods can be varied within the scope of the invention. For examples the measurement of borehole profile can be made up of measurements from a number of different tools or techniques. Other changes will be apparent.

While the invention has been described above in relation to a helical, open (uncased) borehole, it can be applied to any form of borehole. For example, the path may not be helical, but may deviate unpredictably along the length of interest. Also, the borehole may be cased and the tubular can be any long tubular that needs to be inserted into the well, e.g. completion tubulars, screens etc. In cased boreholes, it is the position of the innermost casing surface that is measured to find the position of the borehole wall.

The invention claimed is:

1. A method implemented by a product that uses data from a caliper tool, the method for determining the size of pipe diameter to be inserted into an interval of a borehole, comprising the steps of:

determining the position of the borehole wall in the interval based on data from a caliper tool;

defining a filter window length that is less than the length of the interval and defining a series of filter windows along the interval;

for each filter window, using the determined position of the borehole wall in that filter window to define a polygon, the edges of which are defined by the parts of the borehole wall closest to the borehole axis in that filter window;

determining the maximum size of pipe diameter that will fit inside the polygon in each filter window without intersecting the edges; and determining the size of pipe to be inserted into the interval based on the maximum size of pipe diameter determined for each filter window.

2. The method as claimed in claim 1, further comprising defining a point in each filter window to which the determined maximum pipe diameter is assigned.

3. The method as claimed in claim 2, wherein each filter window is separated from said filter window's neighbours by a predetermined distance.

4. The method as claimed in claim 3, wherein the step of defining a polygon comprises connecting caliper measurement points around the borehole in the filter window.

5. The method as claimed in claim 1, wherein the step of determining the position of the borehole wall comprises making a series of caliper measurements at different depths in the borehole.

6. The method as claimed in claim 1, comprising determining the position of the borehole wall using a measurement tool comprising a tool body that is moved through the borehole, the method comprising determining any rotation of the tool body as said tool body is moved through the well and using the determined rotation to correct the determination of the position of the borehole wall.

7. The method as claimed in claim 1, comprising determining the position of the borehole wall using a measurement tool comprising a tool body that is moved along the borehole, the method further comprising determining any lateral displacement of the tool body as said tool body is moved through the borehole, and using the determined lateral displacement to correct the determination of the position of the borehole wall.

8. The method as claimed in claim 1, comprising selecting the filter window length according to the bending stiffness of the pipe.

9. The method as claimed in claim 1, comprising selecting the size of the pipe to be less than the minimum maximum pipe diameter determined in any filter window in the interval.

10. The method as claimed in claim 1, wherein the borehole is cased in the interval, the step of determining the position of the borehole wall comprising determining the position of the innermost surface of casing in the interval.

11. The method as claimed in claim 1, wherein the pipe is a casing and the interval of a borehole is a portion of an uncased borehole.

12. The method as claimed in claim 1 further comprising inserting a pipe of the determined size into the interval of the borehole.

13. A method for determining a size of a pipe to minimize sticking of the pipe in an interval of a borehole, the method comprising the steps of:

receiving logging data for an interval of a borehole;

based on the data, computing the position of the borehole wall in the interval;

defining a filter window length that is less than the length of the interval and defining a series of filter windows along the interval;

for each filter window, using the computed position of the borehole wall in that filter window to define a polygon, the edges of which are defined by the parts of the borehole wall closest to the borehole axis in that filter window;

computing the maximum size of pipe diameter that will fit inside the polygon in each filter window without intersecting the edges; and determining the size of pipe for insertion into the interval based on the maximum size of pipe diameter determined for each filter window.

14. The method as claimed in claim 13 further comprising manipulating a logging tool to log data.

15. The method as claimed in claim 13 wherein the step of receiving logging data comprises receiving accelerometer data.

16. The method as claimed in claim 15 wherein the step of receiving logging data further comprises receiving finger measurements from a multi-finger caliper tool.

17. The method as claimed in claim 13 implemented by a product that uses logging data from a caliper tool.

18. The method as claimed in claim 13 implemented on a computer readable medium.

* * * * *